US007448131B2

(12) United States Patent
Yoon et al.

(10) Patent No.: US 7,448,131 B2
(45) Date of Patent: Nov. 11, 2008

(54) METHOD OF MAKING GATE FOR CHARGED PARTICLE MOTION

(75) Inventors: Oh-Kyu Yoon, Stanford, CA (US); Richard N. Zare, Stanford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 99 days.

(21) Appl. No.: 11/701,697

(22) Filed: Feb. 2, 2007

(65) Prior Publication Data

US 2007/0180693 A1 Aug. 9, 2007

Related U.S. Application Data

(60) Provisional application No. 60/771,235, filed on Feb. 7, 2006.

(51) Int. Cl.
*H01R 43/00* (2006.01)

(52) U.S. Cl. ..... 29/825; 29/602.1; 250/287

(58) Field of Classification Search ..... 29/825, 29/868, 872; 250/287
See application file for complete search history.

(56) References Cited

U.S. PATENT DOCUMENTS 4,150,319 A 4/1979 Nowak et al.
4,437,034 A 3/1984 Lewandowski et al.
5,465,480 A 11/1995 Karl et al.
6,661,001 B2 12/2003 Park
6,664,545 B2 12/2003 Kimmel et al.
6,781,120 B2 8/2004 LeCursi et al.
6,977,381 B2 * 12/2005 Charles et al. ..... 250/396 R
2005/0258514 A1 11/2005 Smith et al.
2006/0231751 A1 10/2006 Zuleta et al.

OTHER PUBLICATIONS

Stoermer, Carsten et al. "A High Resolution Dual Mass Gate for Ion Separation in Laser Desorpttion/Ionization Time of Flight Mass Spectrometry," Jan. 26, 1998. vol. 69 No. 4, Apr. 1998. American Institute of Physics, Review of Scientific Instruments.
Vlasak, Paul R. et al. "An Interleaved Comb Ion Deflection Gate for m/z Selection in Time-Of-Flight Mass Spectrometry," Oct. 16, 1995. vol. 67, No. 1, Jan. 1996. American Institute of Physics, Review of Scientific Instruments.

(Continued)

*Primary Examiner*—C. J. Arbes
(74) *Attorney, Agent, or Firm*—Lumen Patent Firm, Inc.

(57) ABSTRACT

A Bradbury-Nielson gate (BNG) includes a set of evenly spaced, co-planar, and parallel wires. The wires alternate in a repeating ABAB pattern, where all of the A wires are electrically connected to each other, all of the B wires are electrically connected to each other, and the set of A wires is electrically isolated from the set of B wires. Improved fabrication of Bradbury-Nielson gates is provided based on two key ideas. The first key idea is the use of wire positioning template surfaces having wire insertion features with enhanced spacing. Wire insertion features having enhanced spacing allow for non-microscopic assembly of finely spaced wire arrays. The second key idea is the use of two template surfaces, each having wires spaced by twice the eventual gate wire spacing. The use of two template surfaces facilitates making the alternating electrical contact required for a BNG.

16 Claims, 6 Drawing Sheets

OTHER PUBLICATIONS

Brock, Ansgar et al. "Characterization of a Hadamard Transform Time-Of-Flight Mass Spectrometer," Nov. 29, 1999. Vo. 71 No. 3, Mar. 2000. American Institute of Physics, Review of Scientific Instruments.

Kimmel, Joel, et al. "Novel Method for the Production of finely Spaced Bradbury-Nielson Gates," Aug. 27, 2001. vol. 72 No. 15, Dec. 2001. 2001 American Institute of Physics, Review of Scientific Instruments.

Szumlas, Andrew W. "Design and Construction of a Methanically Simple, Interdigitated-Wire Ion Gate," Aug. 12, 2005. vol. 75 No. 086108. 2005. American Institute of Physics, Review of Scientific Instruments.

* cited by examiner

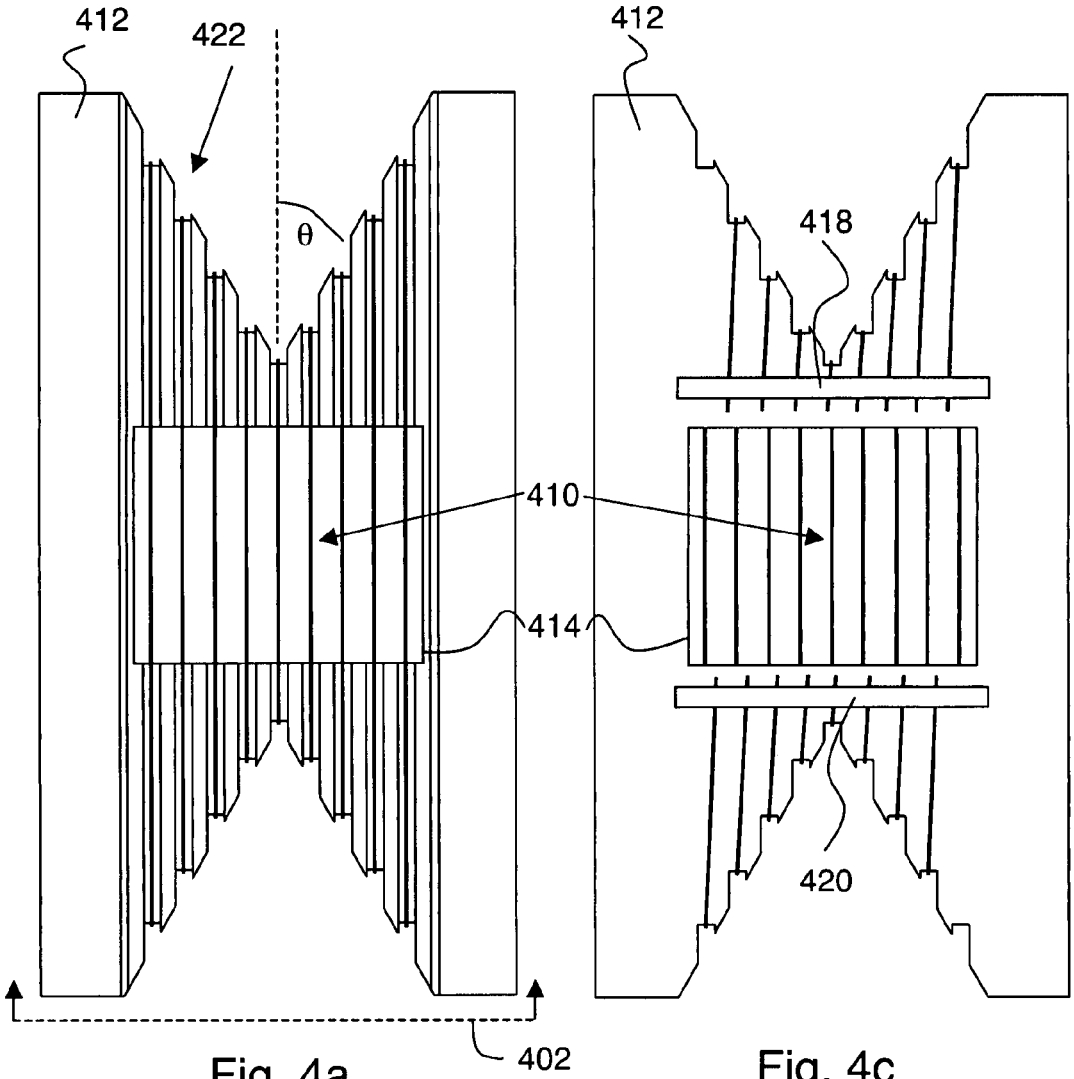
Fig. 4a
Fig. 4c
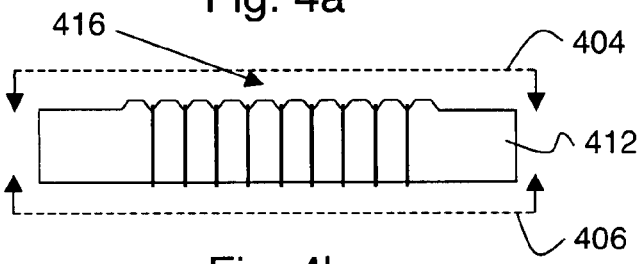
Fig. 4b

METHOD OF MAKING GATE FOR CHARGED PARTICLE MOTION

CROSS REFERENCE TO RELATED APPLICATIONS

This application claims the benefit of U.S. provisional patent application 60/771,235, filed on Feb. 7, 2006, entitled "Template-Based Fabrication of Bradbury-Nielson Gates", and hereby incorporated by reference in its entirety.

GOVERNMENT SPONSORSHIP

This invention was made with Government support under contract number FA9550-04-1-0076 from the AFOSR. The Government has certain rights in this invention.

FIELD OF THE INVENTION

This invention relates to wire gates for controlling charged particle motion.

BACKGROUND

Motion of charged particles is often controlled by wire gates, as employed in applications such as electron microscopy, mass spectrometry, and ion mobility spectrometry. Electric fields can be generated by applying electric potentials to the wires, and these electric fields can act on charged particles to alter their motion. Many different kinds of wire gates have been considered in the art for controlling charged particle motion. One kind of gate commonly known as a Bradbury-Nielson gate (BNG) can provide excellent performance, especially in demanding applications requiring precise timing control, such as Hadamard transform time-of-flight mass spectrometry.

A BNG includes a set of evenly spaced, co-planar, and parallel wires. The wires alternate in a repeating ABAB pattern, where all of the A wires are electrically connected to each other, all of the B wires are electrically connected to each other, and the set of A wires is electrically isolated from the set of B wires. The main advantage of the BNG is that its electric field decays very rapidly as distance increases away from the plane of the wires. The deflection region, where electric fields are non-negligible, extends out to about one wire spacing from the plane of the BNG. Thus decreasing the BNG wire spacing decreases the size of the deflection region, which in turn improves the time resolution of the BNG.

Although fabrication of BNGs having large wire spacing tends to be straightforward, BNG fabrication difficulty increases significantly as the wire spacing decreases. The main difficulties encountered are precisely placing the wires of the BNG (i.e., so they are parallel, co-planar and evenly spaced with the desired spacing), and providing alternating electrical contact to the BNG wires as described above. These fabrication difficulties are further increased by the common requirement in practice that the BNG have a large active area (i.e., on the order of 5 cm×5 cm).

Several methods have been considered in the art to address some of these issues. In an article by Vlasek et al. (Rev. Sci. Instrum., 67(1), pp. 68-72, January 1996) a wire spacing of 1 mm was achieved by weaving a wire through holes drilled through two frames separated by two threaded rods. An article by Stoermer et al. (Rev. Sci. Instrum., 69(4), pp. 1661-1664, April 1998) demonstrated a wire spacing of 0.5 mm by winding wire on the threads of two nylon screws. A wire spacing of about 0.16 mm is reported by Brock et al. (Rev. Sci. Instrum., 71(3), pp. 1306-1318, March 2000), where wire segments are individually soldered to electrode pads on the BNG frame. The wire positioning and soldering in this case entailed time-consuming manual assembly under a microscope.

A template based approach for BNG fabrication was considered by Kimmel et al. (Rev. Sci. Instrum., 72(12), pp. 4354-4357, December 2001, and in U.S. Pat. No. 6,664,545). In this work, 0.1 mm spaced V-grooves are machined into a plastic mount, and then two sets of wires are wrapped into the grooves under a microscope. Although this approach reduces fabrication time compared to the approach of Brock et al., it still entails lengthy microscope assembly work.

Microfabrication methods have also been employed for BNG fabrication. Examples in the art of such methods include U.S. Pat. No. 6,977,381, US Patent Application 2005/0258514, and US Patent Application 2006/0231751. Although microfabrication methods can provide BNGs having very small wire spacing (e.g., as low as 0.015 mm), it is difficult for microfabrication methods to provide BNGs having a large active area. For example, in one report of a microfabricated BNG, the maximum active area was on the order of 5 mm by 5 mm.

Accordingly, it would be an advance in the art to provide a BNG fabrication method for large-area BNGs having small wire spacing that does not require laborious assembly under a microscope.

SUMMARY

Improved BNG fabrication is provided according to embodiments of the invention based on two key ideas. The first key idea is the use of wire positioning template surfaces having wire insertion features with enhanced spacing. Wire insertion features having enhanced spacing allow for non-microscopic assembly of finely spaced wire arrays. For example, insertion features having a spacing of about 1 mm (microscope not necessary) can correspond to a set of grooves spaced by as little as 0.025 mm (microscope required for conventional assembly methods).

The second key idea is the use of two template surfaces, each having wires spaced by twice the eventual gate wire spacing. The use of two template surfaces facilitates making the alternating electrical contact required for a BNG.

BRIEF DESCRIPTION OF THE DRAWINGS

FIGS. 4*a-c* show top, end and bottom views, respectively, of a wire-wound template according to an embodiment of the invention.

DETAILED DESCRIPTION

Figure 1:
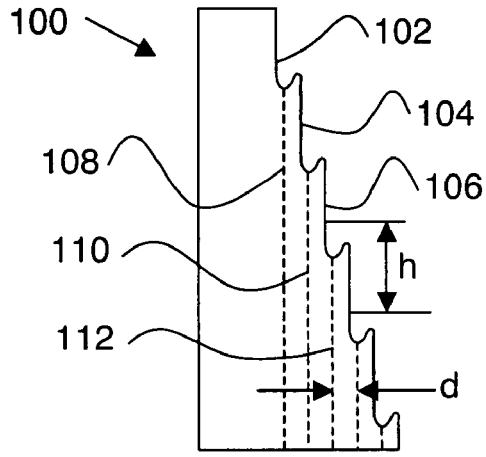
FIG. 1 shows part of a template having wire insertion features according to an embodiment of the invention.

FIG. 1 shows part of a template having wire insertion features according to an embodiment of the invention. Here a template 100 has grooves (e.g., 108, 110, and 112) and corresponding wire insertion features (e.g., 102, 104, and 106). The spacing between adjacent grooves is shown as d, and the spacing between adjacent wire insertion features is shown as h. The insertion feature spacing h is substantially greater than the groove spacing d. This can be accomplished, as shown on FIG. 1, by providing an end face of the array of grooves that intersects the set of grooves at an angle substantially less than 90 degrees (preferably less than 10 degrees). Preferably h is greater than about 1 mm, since a 1 mm separation is about the smallest separation that can readily be wire-wound without using a microscope. The groove spacing d, which is twice the BNG gate spacing, can be selected according to the desired BNG gate spacing. A gate spacing as low as 0.025 mm can be provided, corresponding to a d of 0.05 mm.

Figure 2:
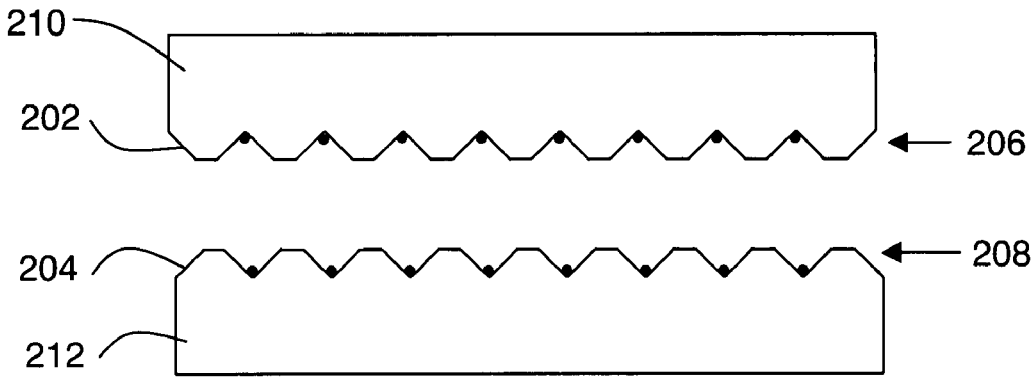
FIG. 2 shows two templates according to an embodiment of the invention in a separated configuration.
Figure 3:
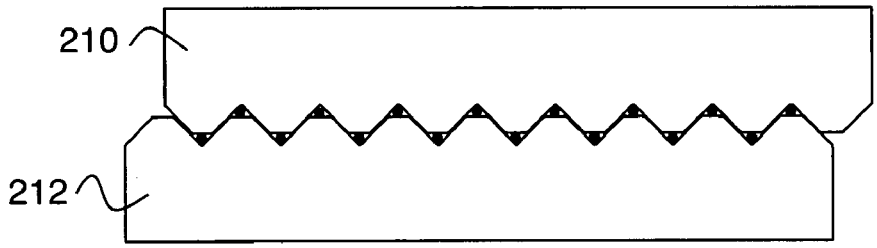
FIG. 3 shows the two templates of FIG. 2 in a mated configuration.

FIG. 2 shows two templates according to an embodiment of the invention in a separated configuration. A first template 210 has a first template surface 202 with grooves in which wires 206 are disposed. A second template 212 has a second template surface 204 in which wires 208 are disposed. FIG. 3 shows the two templates of FIG. 2 in a mated configuration. The surfaces of templates 210 and 212 mate such that the two sets of wires segments on each surface alternate.

FIGS. 1-3 schematically show some key aspects of embodiments of the invention in isolation to facilitate comprehension of key points of the more detailed example of FIGS. 4*a-c* and 5*a-d*.

FIGS. 4*a-c* show top, end and bottom views, respectively, of a wire-wound template according to an embodiment of the invention. FIG. 4*b* shows a view along direction 402 on FIG. 4*a*. FIG. 4*a* shows a view along direction 404 on FIG. 4*b*. FIG. 4*c* shows a view along direction 406 on FIG. 4*b*. A template 412 has a template surface 416 including an array of parallel grooves. Template 412 also has a set of wire insertion features 422, one for each groove, where the separation between adjacent wire insertion features is substantially larger than the groove spacing (i.e., as described in connection with FIG. 1). The enhanced separation of wire insertion features in this example is provided by the acute end face angle θ. Template 412 includes an aperture 414, across which wires 410 extend in a pattern determined by the grooves of surface 416.

Wire is preferably wound onto template 412 by winding a continuous length of wire into the grooves of template surface 416. More specifically, wire can be wrapped repeatedly around the template, alternating between passing through a groove of surface 416 as shown on the top view of FIG. 4*a*, and moving from one groove to the next as shown on the bottom view of FIG. 4*c*. This winding can be guided by wire insertion features 422. Preferably, wire winding is performed with a mechanical jig for keeping the wire under constant tension as it is wound onto the template. Once the winding is complete, the wires can be affixed to the template by members 418 and 420, and then the wires on the bottom surface of template 412 extending across aperture 414 can be removed, providing the wire configuration shown on FIGS. 4*a-c*. The resulting arrangement of wires is a single co-planar and parallel array of wire segments having a spacing defined by the grooves of surface 416 and extending across aperture 414. The details of how the wires are held in position on template 412 are not critical in practicing the invention. Similarly, details relating to how the wires on the bottom surface of template 412 are removed are also not critical in practicing the invention.

Templates for practicing the invention can be formed by any suitable technology, such as machining or lithography. For example, aluminum can be machined to form a suitable template, or silicon can be lithographically patterned (e.g., by deep reactive ion etching (DRIE)) to form a suitable template. In cases where the template is machined from a metal, it is preferred that a black surface finish be applied to the template (e.g., by anodization) to improve visual contrast between the wire (typically gold coated tungsten having a diameter of 0.01 mm to 0.02 mm) and the template.

FIG. 5*a-d* show BNG and template configurations at various points in an exemplary assembly process according to an embodiment of the invention. On FIG. 5*a*, a BNG frame 502 includes an aperture 508 and first electrical contacts 504 and 506. Frame 502 should be electrically insulating and have sufficient mechanical strength to maintain structural integrity. Electrical contacts 504 and 506 can be fabricated of any electrically conductive material (e.g., conductive paint, a metal strip, etc.) such that any two wires that make contact to electrical contact 504 are thereby in electrical contact with each other (and similarly for electrical contact 506). Frame 502 provides mechanical support for the wires of the BNG, which will extend across aperture 508 once fabrication is completed. The composition and dimensions of BNG frame 502 are not critical in practicing the invention. However, one of the advantages of the invention is that BNGs having a large active area (e.g., on the order of 5 cm by 5 cm) can be provided. Optionally, BNG frame 502 can include grooves spaced by the BNG wire spacing d. Wire spacing uniformity can be improved when wires are transferred to a grooved frame as compared to a frame without grooves.

Figure 5A:
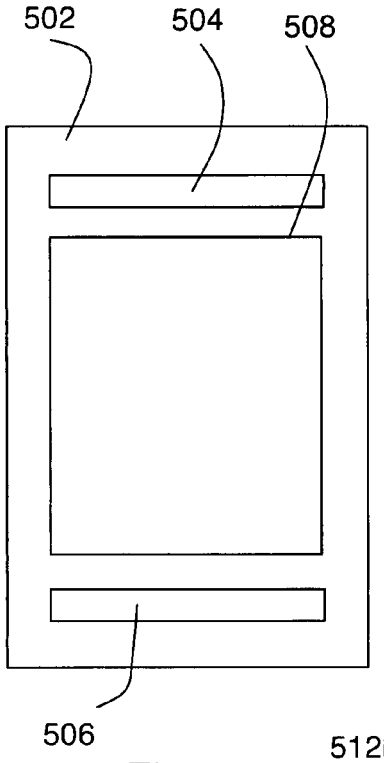
FIG. 5*a-d* show BNG and template configurations at various points in an exemplary assembly process according to an embodiment of the invention.
Figure 5B:
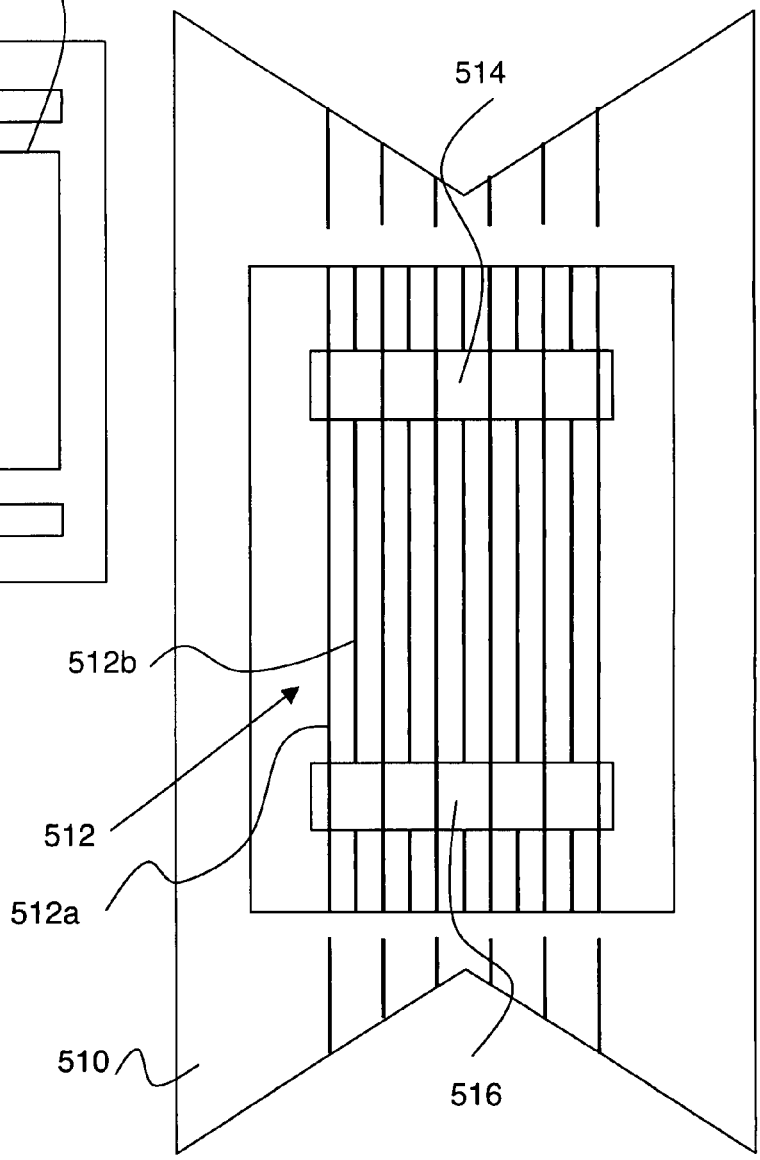

FIG. 5*b* shows an arrangement of two wire-wound templates as in FIGS. 4*a-c* mated as shown in FIG. 3. Although it may be necessary to view the mating of the templates under a microscope to verify proper alternation, such verification is not time consuming. Insulating strips 514 and 516 (e.g., of Teflon® or any other electrically insulating material) are sandwiched between the sets of wires corresponding to the two templates. More specifically, a set of wires 512 includes alternating wires from a first template (one wire being labeled as 512*a*) and a second template (one wire being labeled 512*b*). It is convenient to refer to wire sets 512*a* and 512*b* as including all wires having the same relation to strips 514 and 516 as wires 512*a* and 512*b* respectively. Since insulating strips 514 and 516 are sandwiched between alternating sets of wires, the wires of set 512 pass over and under the insulating strips in an alternating manner, as shown.

Figure 5C:
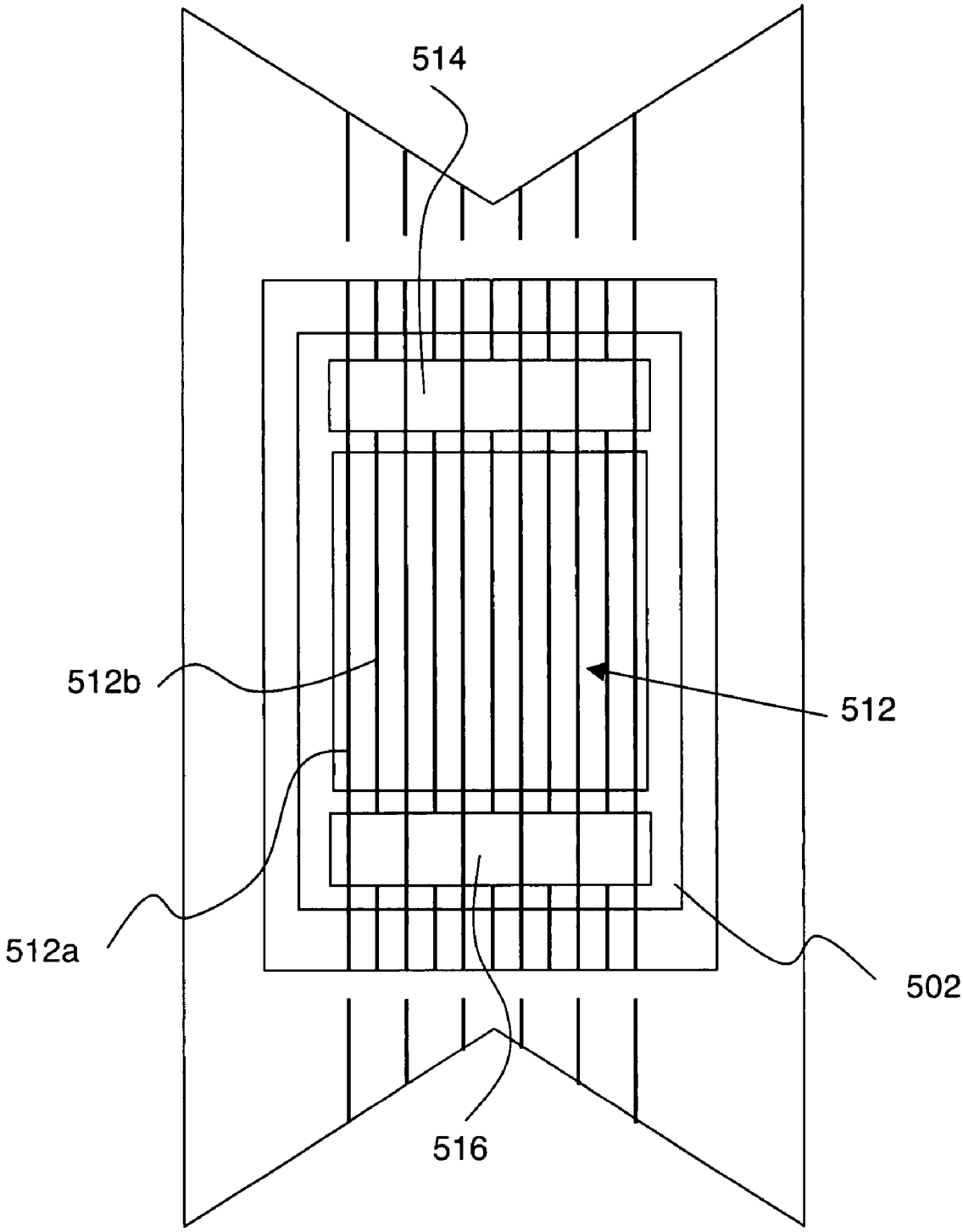

FIG. 5*c* shows the configuration when the wire wound template sandwich of FIG. 5*b* is disposed on top of the BNG frame of FIG. 5*a*. Insulating strips 514 and 516 are aligned with and disposed on top of first contacts 504 and 506, and are disposed away from aperture 508. As a result, the wires of set 512*b* are electrically connected by contacts 504 and 506, while the wires of set 512*a* are isolated from the wires of set 512*b*. At this stage of assembly, wires of set 512 are affixed to frame 502 (e.g., by being secured with metal plates and glued down).

Figure 5D:
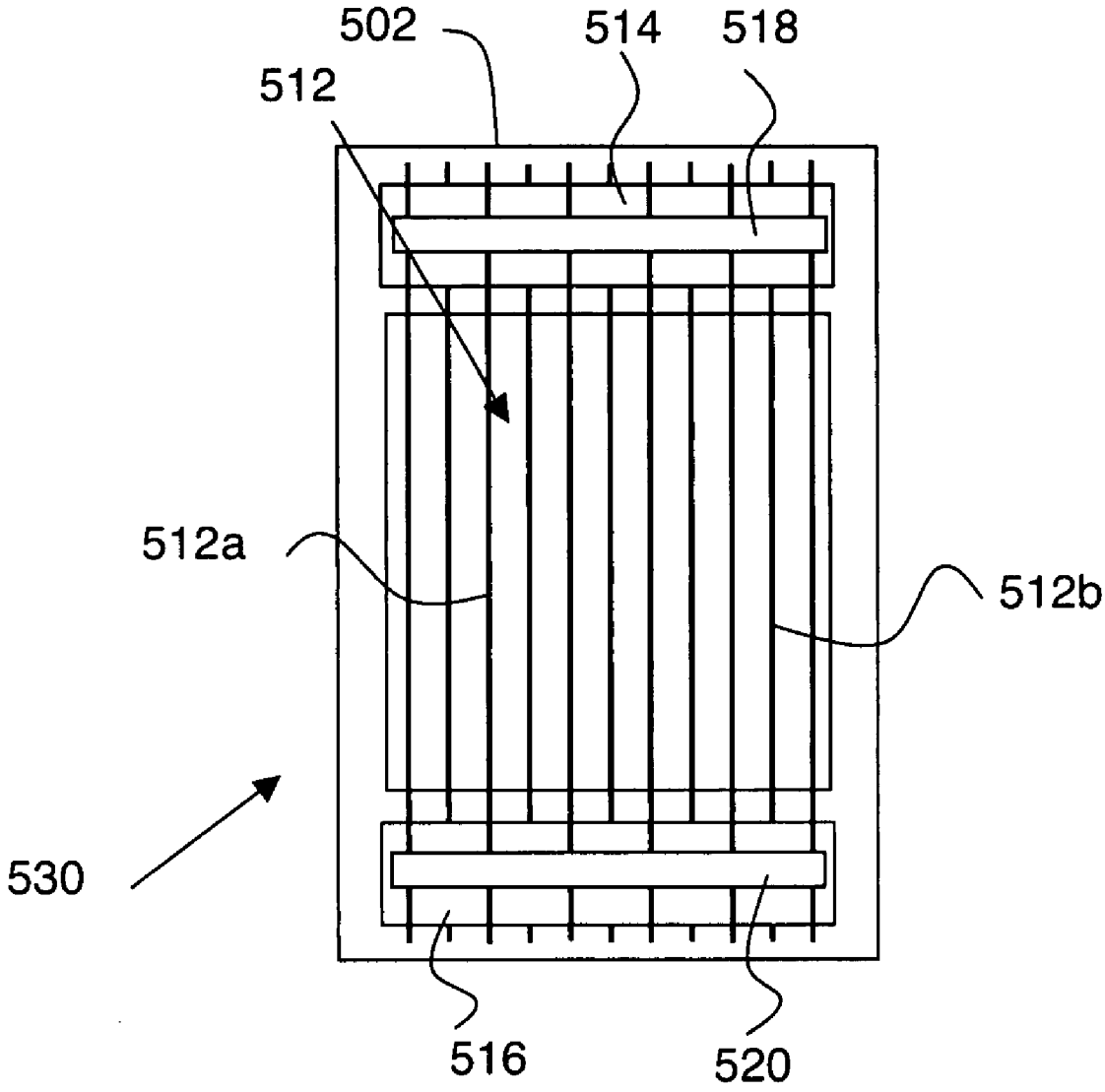

FIG. 5*d* shows the finished BNG resulting from cutting the wires connecting the BNG frame to the template and adding final electrical connections. More specifically, second electrical contacts 518 and 520 are disposed on top of insulating strips 514 and 516. Electrical contact of all the wires of set 512*a* to each other is thereby provided, while electrical isolation between wire sets 512*a* and 512*b* is preserved.

The preceding description of FIGS. 4*a-c* and 5*a-d* amounts to an illustrative example of the following method of fabricating a Bradbury-Nielson gate for controlling charged particle motion.

First, a gate spacing d is selected for the wires of the gate to be fabricated. Second, a first template surface having a first set of parallel grooves separated by 2d is provided, where the first template surface includes a first set of wire insertion features in one to one correspondence with the first set of grooves, and where the spacing of the wire insertion features is substantially larger than 2d. Third, a first set of wire segments is disposed in the first set of grooves by inserting the first set of wire segments into the first set of wire insertion features. These wire segments are preferably sections of a single continuous length of wire at the time wire winding is done.

Fourth, a second template surface having a second set of parallel grooves separated by 2d is provided, where the second template surface includes a second set of wire insertion features in one to one correspondence with the second set of grooves, and where the spacing of the wire insertion features is substantially larger than 2d. Fifth, a second set of wire segments is disposed in the second set of grooves by inserting the second set of wire segments into the second set of wire insertion features. These wire segments are also preferably sections of a single continuous length of wire at the time wire winding is done.

Sixth, attaching the first and second sets of wire segments to a frame such that wire segments from the first and second sets of wire segments are co-planar, parallel and alternating between the first and second sets of wire segments.

Seventh, making a first electrical connection such that all of the first set of wire segments are in electrical contact.

Eighth, making a second electrical connection such that all of the second set of wire segments are in electrical contact and such that the first and second sets of wire segments are electrically isolated from each other.

According to the invention, wire weaving for BNGs having wire spacing as small as 0.025 mm can be done in about 1-2 hours without using a microscope. Such BNGs can also have large active areas (e.g., on the order of 5 cm by 5 cm). Fabrication of BNGs according to methods of the invention with wire spacing of 0.05 mm, 0.1 mm, 0.2 mm and 0.5 mm has been performed. In these tests, wire weaving time for a 10 mm by 15 mm active area BNG with 0.1 mm wire spacing was about one hour, and wire weaving time for a 8 mm by 15 mm active area BNG with 0.05 mm wire spacing was about two hours. The performance of the resulting gates was characterized experimentally and compared with theoretical calculations based on the idealized BNG geometry. Close agreement between experiment and theory was obtained, indicating close agreement between ideal BNG geometry and the actual as-fabricated BNG geometry. The uniformity of the wire spacing was also directly measured. The BNGs having wire spacing of 0.5 mm, 0.2 mm, 0.1 mm and 0.05 mm had a spacing standard deviation of 0.03 mm (6%), 0.014 mm (7%), 0.0065 mm (6.5%), and 0.009 mm (18%), respectively.

Although template fabrication time can be significant, once fabricated, templates can be reused to fabricate multiple BNGs.

The preceding example shows BNG fabrication using two separate templates. It is also possible to employ a single template for BNG fabrication according to another embodiment of the invention.

Figure 6A:
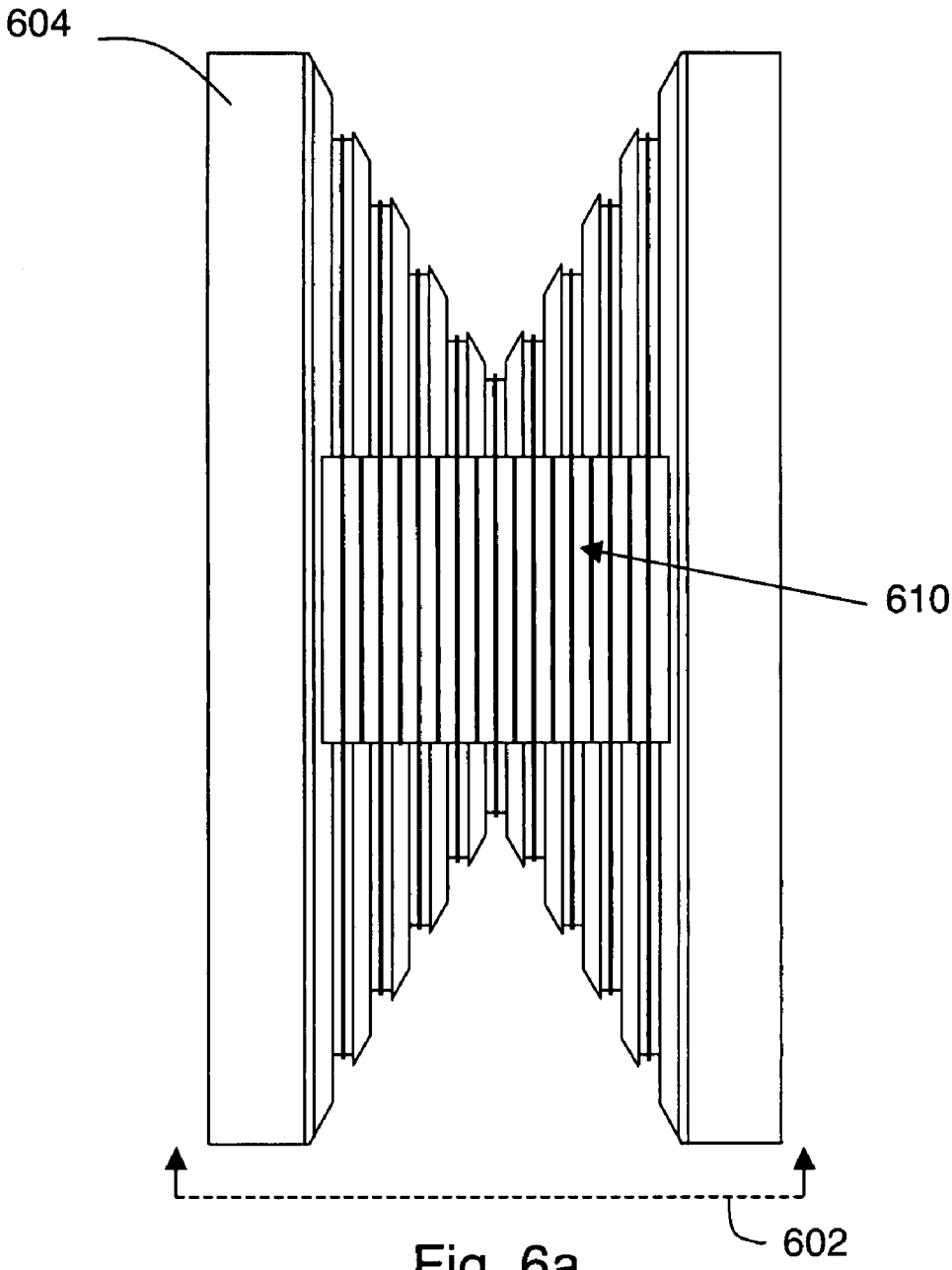
FIGS. 6*a-b* show top and end views, respectively, of a wire-wound template according to an alternate embodiment of the invention.
Figure 6B:
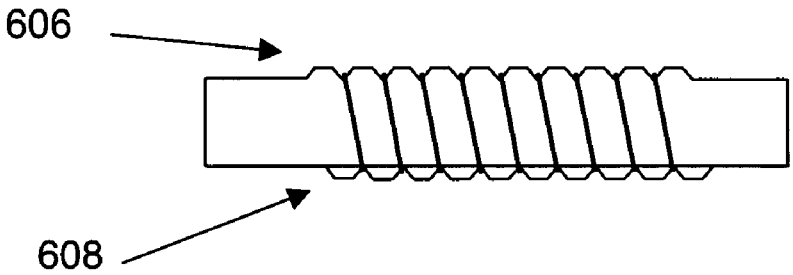

FIGS. 6*a-b* show top and end views, respectively, of a wire-wound template according to an alternate embodiment of the invention using a single template. FIG. 6*b* shows a view along direction 602 of FIG. 6*a*. A template 604 has a first template surface 606 and a second template surface 608, each template surface having an array of parallel grooves. Each groove has a corresponding wire insertion feature, and the spacing of the wire insertion features is substantially greater than the groove spacing. The two arrays of grooves have the same spacing, and are offset from each other by half their groove spacing, as shown on FIG. 6*b*. Wire can be wound into the grooves of template 604 as described above, resulting in an array of wire segments 610 extending across an aperture of template 604. Preferably, the groove depths of the two template surfaces are selected so that the wires are in or nearly in the same plane. It is also preferable to dispose one or more insulating strips (not shown on FIG. 6*a*) in the aperture of template 604 prior to wire winding, to provide an arrangement of wires and insulators that facilitates making the alternating electrical connections of a BNG (e.g., as described above in connection with FIGS. 5*a-d*).

As indicated above, machining and microlithography are both suitable techniques for fabricating templates. Machining is suitable for BNG wire spacing of about 0.05 mm or greater, since machining precision tends to be sufficiently accurate for such spacing. For reduced wire spacing (e.g., about 0.025 mm to about 0.05 mm), a lithographic single-template approach is preferred.

For example, a 4" silicon wafer can have 0.1 mm deep channels etched into its front and back surfaces by DRIE forming two sets of parallel grooves offset by half the groove spacing (as on FIG. 6*b*). Wire insertion features for each groove as described above can be patterned into the surfaces of the silicon wafer. A transparency mask process at 3600 dpi can provide sufficient photolithographic resolution. Although a chrome mask process can provide the resolution required for smaller wire spacing (i.e., less than 0.025 mm), wires having a sufficiently small diameter for such spacing tend to be too mechanically fragile to withstand the weaving procedure. Accordingly, BNGs having such small wire spacing are preferably fabricated by other methods (e.g., microfabrication) that do not entail winding wire on a template.

The preceding description has been by way of example as opposed to limitation, and numerous variations of the given examples can be made in practicing the invention. For example, the material composition of the templates, BNG frames, and wires is not critical in practicing the invention, and any suitable material may be chosen for these elements. Similarly, the details of how wires are affixed to the BNG frame are not critical for practicing the invention.

The invention claimed is:

1. A method of fabricating a gate for controlling charged particle motion, the method comprising:

selecting a gate spacing for wires of said gate;

providing a first template surface having a first set of parallel grooves separated by twice said gate spacing and having a first set of wire insertion features in one to one correspondence with said first set of parallel grooves, wherein adjacent members of said first set of wire insertion features are spaced apart by a distance substantially greater than twice said gate spacing;

disposing a first set of wire segments in said first set of grooves by inserting said first set of wire segments into said first set of wire insertion features;

providing a second template surface having a second set of parallel grooves separated by twice said gate spacing and having a second set of wire insertion features in one to one correspondence with said second set of parallel grooves, wherein adjacent members of said second set of wire insertion features are spaced apart by a distance substantially greater than twice said gate spacing;

disposing a second set of wire segments in said second set of grooves by inserting said second set of wire segments into said second set of wire insertion features;

attaching said first and second sets of wire segments to a frame such that wire segments from said first and second sets of wire segments are co-planar, parallel, and alternating between said first and second sets of wire segments;

making a first electrical connection such that all of said first set of wire segments are in electrical contact; and making a second electrical connection such that all of said second set of wire segments are in electrical contact, and such that said first set of wire segments and said second set of wire segments are electrically isolated from each other.

2. The method of claim 1, wherein said first set of wire insertion features comprises an end face of said first set of parallel grooves that intersects said first set of parallel grooves at an angle substantially less than 90 degrees.

3. The method of claim 2, wherein said angle is less than about 10 degrees.

4. The method of claim 2, wherein a spacing of said first set of wire insertion features along said end face is greater than about 1 mm.

5. The method of claim 1, wherein said second set of wire insertion features comprises an end face of said second set of parallel grooves that intersects said second set of parallel grooves at an angle substantially less than 90 degrees.

6. The method of claim 5, wherein said angle is less than about 10 degrees.

7. The method of claim 5, wherein a spacing of said second set of wire insertion features along said end face is greater than about 1 mm.

8. The method of claim 1, wherein said first template surface and said second template surfaces are opposite surfaces of a single template.

9. The method of claim 8, wherein said first and second template surfaces of said single template are arranged such that said first and second sets of parallel grooves are parallel, alternating and evenly spaced.

10. The method of claim 1, wherein said first template surface is a surface of a first template and said second template surface is a surface of a second template separate from said first template.

11. The method of claim 10, wherein said attaching said first and second sets of wire segments to said frame comprises:

disposing said first and second template surfaces together such that said first and second sets of wire segments alternate; and attaching said alternating wire segments to said frame.

12. The method of claim 1, wherein said disposing a first set of wire segments comprises winding a continuous length of wire on said first template surface.

13. The method of claim 1, wherein said disposing a second set of wire segments comprises winding a continuous length of wire on said second template surface.

14. The method of claim 1, wherein said attaching said first and second sets of wire segments to said frame comprises:

sandwiching at least one electrically insulating strip between said first set of wire segments and said second set of wire segments;

attaching said first and second sets of wire segments and said at least one electrically insulating strip to said frame after said sandwiching;

wherein said at least one electrically insulating strip is disposed away from an aperture of said frame.

15. The method of claim 14, wherein said second set of wire segments is disposed on top of said at least one electrically insulating strip, and wherein said second electrical connection comprises a conductor disposed on top of said at least one electrically insulating strip and making contact with said second set of wire segments without making contact with said first set of wire segments.

16. The method of claim 1, wherein said first and second template surfaces are formed by a process selected from the group consisting of machining and lithography.

* * * * *